US010660417B2

(12) United States Patent
Bennett

(10) Patent No.: US 10,660,417 B2
(45) Date of Patent: May 26, 2020

(54) HAIR DRYING AND STYLING SYSTEM

(71) Applicant: Cheryl Bennett, Huntington Beach, CA (US)

(72) Inventor: Cheryl Bennett, Huntington Beach, CA (US)

( * ) Notice: Subject to any disclaimer, the term of this patent is extended or adjusted under 35 U.S.C. 154(b) by 380 days.

(21) Appl. No.: 15/813,129

(22) Filed: Nov. 14, 2017

(65) Prior Publication Data

US 2018/0192756 A1 Jul. 12, 2018

Related U.S. Application Data

(60) Provisional application No. 62/444,143, filed on Jan. 9, 2017.

(51) Int. Cl.

| | |
|---|---|
| ***A45D 6/02*** | (2006.01) |
| ***A45D 4/10*** | (2006.01) |
| ***A45D 20/50*** | (2006.01) |
| ***A45D 6/04*** | (2006.01) |
| ***A45D 2/14*** | (2006.01) |
| ***A45D 20/12*** | (2006.01) |
| ***A45D 1/04*** | (2006.01) |
| ***A45D 2/24*** | (2006.01) |

(52) U.S. Cl.

CPC ..... *A45D 4/10* (2013.01); *A45D 1/04* (2013.01); *A45D 2/145* (2013.01); *A45D 2/148* (2013.01); *A45D 2/2471* (2013.01); *A45D 6/04* (2013.01); *A45D 20/12* (2013.01); *A45D 20/50* (2013.01)

(58) Field of Classification Search

CPC ... A45D 2/00; A45D 2/02; A45D 2/04; A45D 2/06; A45D 2/08; A45D 2/10; A45D 2/12; A45D 2/145; A45D 2/148; A45D 2/2471; A45D 2/2485; A45D 2/36; A45D 2/367; A45D 4/18; A45D 4/10; A45D 6/00; A45D 6/02; A45D 6/04; A45D 20/12; A45D 20/48; A45D 20/50; A45D 20/52; A45D 2006/005

See application file for complete search history.

(56) References Cited

U.S. PATENT DOCUMENTS

| | | | | | |
|---|---|---|---|---|---|
| 2,748,779 | A * | 6/1956 | Crothers | A45D 6/04 | 132/237 |
| 3,322,144 | A | 5/1967 | De Boer, Jr. et al. | | |
| 4,365,426 | A | 12/1982 | Suzuki | | |
| 5,887,600 | A | 3/1999 | Wilk | | |
| 5,975,091 | A * | 11/1999 | Balanchi | A45D 6/04 | 132/237 |
| 6,067,724 | A * | 5/2000 | Depoyian | A45D 20/12 | 34/97 |
| 6,070,597 | A | 6/2000 | Motherhead | | |
| 6,098,635 | A | 8/2000 | Marino | | |
| 8,490,633 | B1 * | 7/2013 | Kennedy | A45D 1/16 | 132/228 |
| 2011/0114111 | A1 | 5/2011 | Guthans | | |

* cited by examiner

*Primary Examiner* — Rachel R Steitz
(74) *Attorney, Agent, or Firm* — Charles Runyan

(57) ABSTRACT

A hair drying and styling system includes a hair styling tool assembly having a handle, a split barrel having, a first-member, and a second-member, a detachable brush attachment, a power source, a control panel, and a hair dryer. The device provides a hair styling tool with detachable brush attachments which may be used for drying hair. The detachable brush attachments may be rotatable for drying with the hair dryer and once detached provides a hair curler which may be left in the hair.

18 Claims, 5 Drawing Sheets

HAIR DRYING AND STYLING SYSTEM

CROSS REFERENCE TO RELATED APPLICATION

The present application is related to and claims priority to U.S. Provisional Patent Application No. 62/444,143 filed Jan. 9, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of hair styling tools and more specifically relates to a hair drying and styling tool system.

2. Description of Related Art

Many people enjoy styling their hair. Hairstyling refers to the styling of hair, usually on the human scalp. The fashioning of hair can be considered an aspect of personal grooming, fashion, and cosmetics, although practical, cultural, and popular considerations also influence some hairstyles. Hair styles can be achieved by using tools such as blow dryers, brushes, and curlers to achieve a desired look. After drying one's hair, many like to style or curl it to give it extra body. However, using a curling iron or hot rollers after using a hair dryer can add an additional 30 to 45 minutes to the process. In addition, the styling tools can cause damage to the hair due to the excessive heat required for styling. Many times the curl falls out of the hair quickly because a curling iron does not give the hair a chance to cool down and set. It can also be difficult for users to select the size of curl they need for different areas of the hair. A suitable solution is desired.

U.S. Pub. No. 2011/0114111 to Debra E. Guthans relates to a hair styling tool with detachable handle. The described hair styling tool with detachable handle includes a hair styling tool kit having cylindrical hair roller(s) having bristles positioned on exterior thereof, an open proximate end, a closed distant end and an inner cavity. A magnet is fitted in the distant end of the hair roller, and a mating magnet is fitted in a roller engaging portion of the handle. The handle is configured to detachably engage the proximate end of the hair roller(s), one at a time, and facilitate rolling of hair on the hair roller(s). The magnets retain the hair roller engaged with the handle during the hair rolling process while rotation of the hair roller in relation to the handle is prevented.

BRIEF SUMMARY OF THE INVENTION

In view of the foregoing disadvantages inherent in the known hair styling tools art, the present disclosure provides a novel hair drying and styling system. The general purpose of the present disclosure, which will be described subsequently in greater detail, is to provide a handheld styling tool with a brush attachment on the end designed to dry and curl the hair.

A hair drying and styling system is disclosed herein. The hair drying and styling system includes a hair styling tool assembly having a handle, a split barrel having, a first-member, and a second-member, a detachable brush attachment, a power source, a control panel, and a hand-held hair dryer. The split barrel and the detachable brush attachment comprise a plurality of apertures for allowing passage of air from the hair dryer to the hair wrapped around the detachable brush attachment. The detachable brush attachment is able to be removed from the split barrel when a release button of the control panel is manipulated to press the first-member and the second-member together. The detachable brush head may be released from one end of the device and a new detachable brush head may be locked into place for drying a new section of hair. The detachable brush head when detached provides a hair curler which may be left in the hair.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a hair drying and styling system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a hair styling tool and more particularly to a hair drying and styling system as used to improve the drying and styling of hair.

Generally, the hair drying and styling system is designed to blow dry and curl hair simultaneously. It eliminates the need to use a curling iron or hot rollers after the hair is dry. This reduces the time it takes to dry and style the hair and reduces damage to the hair caused by heated styling tools. It includes a handheld dryer with detachable brushes that remain in place in the hair until cool. The present invention offers detachable brush heads in multiple sizes to accommodate different lengths and styles of hair. Hair drying and styling system is a handheld styling tool with a brush attachment on the end designed to dry and curl the hair. The invention is comprised of a hand-held dryer that has a detachable brush end. Depending on the length and volume of someone's hair would determine the size of the detachable brushes one would use. The detachable brushes may also be attached to a conventional hair drying device.

The device may be provided with various sized detachable brush head. There is a slide switch control to rotate the detachable brush heads forward and backward. There is a release button to close the tip to allow the detachable brush heads to be removed. There is also a normal control setting for heat or steam. Holes in the device allow steam or air to pass through. The unit may be powered by battery or a power cord. In use, the user dries the hair in sections by rotating the brush head through the hair several times until dry. The steam/warm air is dispersed through the holes and through the brush head to dry the hair. Once a section is dry, the user may press the release button to release the brush head attachment. The detachable brush head is released from the end of the dryer and a new detachable brush head may be locked into place for drying a new section of hair. The detachable brush heads stay rolled into the hair until cool to set the curl/volume in place.

Figure 1:
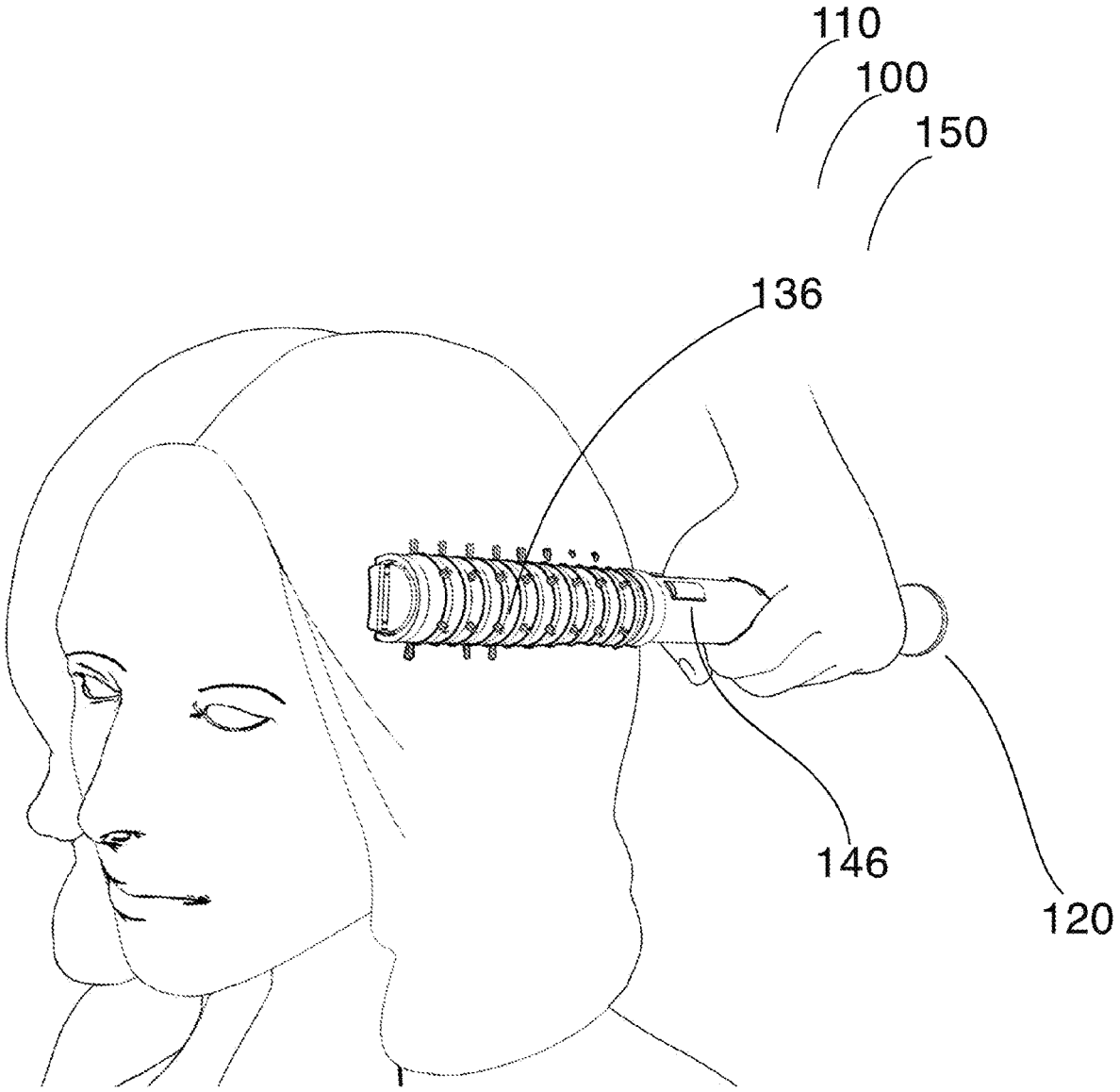
FIG. 1 is a perspective view of the hair drying and styling system during an 'in-use' condition, according to an embodiment of the disclosure.

Referring now more specifically to the drawings by numerals of reference, there is shown in FIGS. 1-5, various views of a hair drying and styling system 100. FIG. 1 shows a hair drying and styling system 100 during an 'in-use' condition 150, according to an embodiment of the present disclosure. As illustrated, the hair drying and styling system 100 may include a hair styling tool assembly 110 having a handle 120, a split barrel 124 having a first-member 128, and a second-member 132, a detachable brush attachment 136, a power source 140, a control panel 144, and a hair dryer 160. The hair styling tool assembly 110 comprises the handle 120, the split barrel 124, the detachable brush attachment 136; the power source 140, the control panel 144, and the hair dryer 160 in functional combination eliminating the need for hot rollers and/or curling irons.

Figure 2A:
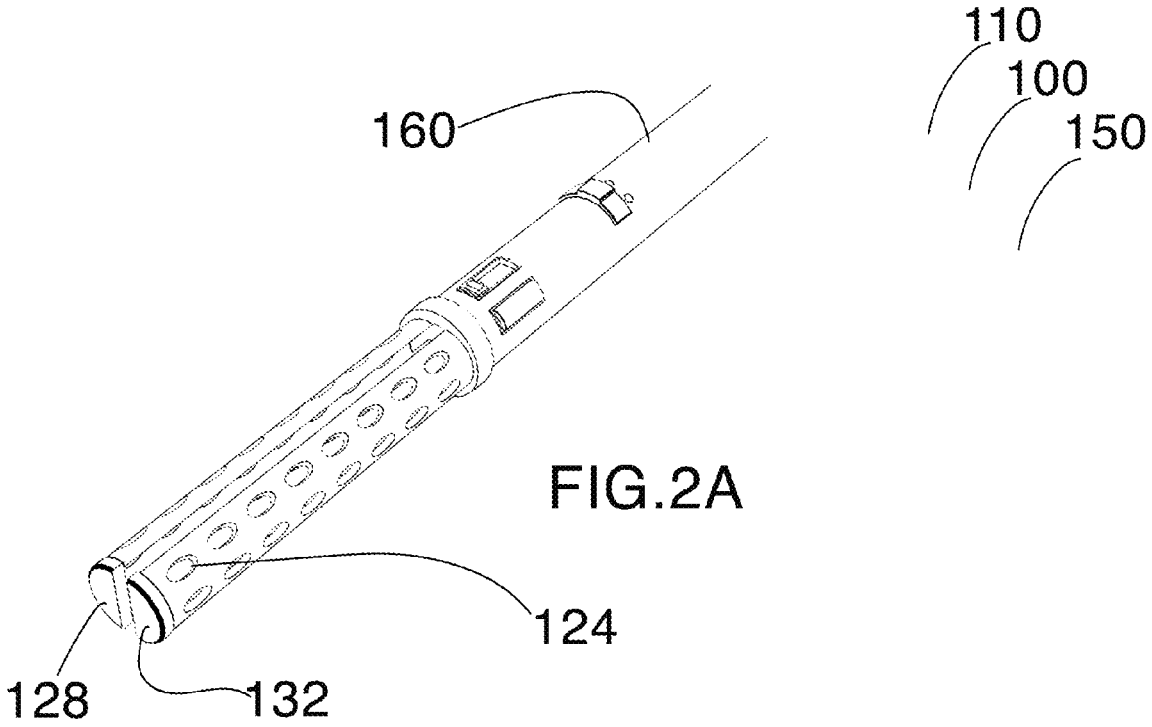
FIG. 2A is a perspective view of the hair drying and styling system of FIG. 1, according to an embodiment of the present disclosure.
Figure 2B:
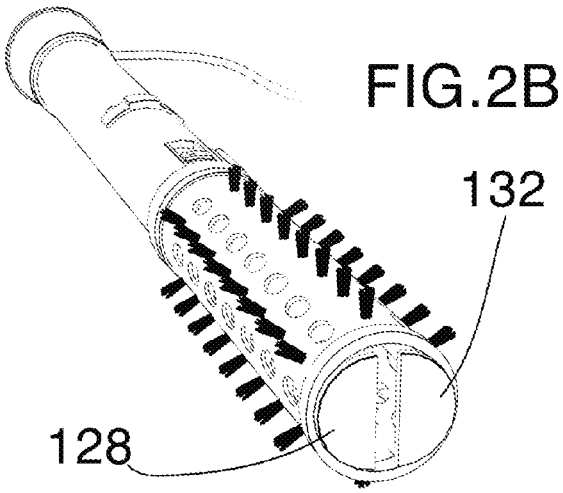
FIG. 2B is a perspective view of the hair drying and styling system of FIG. 1, according to an embodiment of the present disclosure.

FIGS. 2A-2B show front perspective views of the hair drying and styling system 100 of FIG. 1, according to an embodiment of the present disclosure. As above, the hair drying and styling system 100 may include the hair styling tool assembly 110 having the handle 120, the split barrel 124 having the first-member 128, and the second-member 132, the detachable brush attachment 136, the power source 140, the control panel 144, and the hair dryer 160. The split barrel 124 comprises the first-member 128 and the second-member 132 opposed in relation to each other. The detachable brush attachment 136 is configured to be securable around the first-member 128 and the second-member 132. The first-member 128 and the second-member 132 are able to be manipulated via the control panel 144 creating a space between the first-member 128 and the second-member 132. The detachable brush attachment 136 is able to be removed from the split barrel 124 when a release button 146 of the control panel 144 is manipulated to press the first-member 128 and the second-member 132 together. The detachable brush attachment 136 is configured to be detached when hair is dried and provides a hair curler which may be left in the hair.

Figure 3:
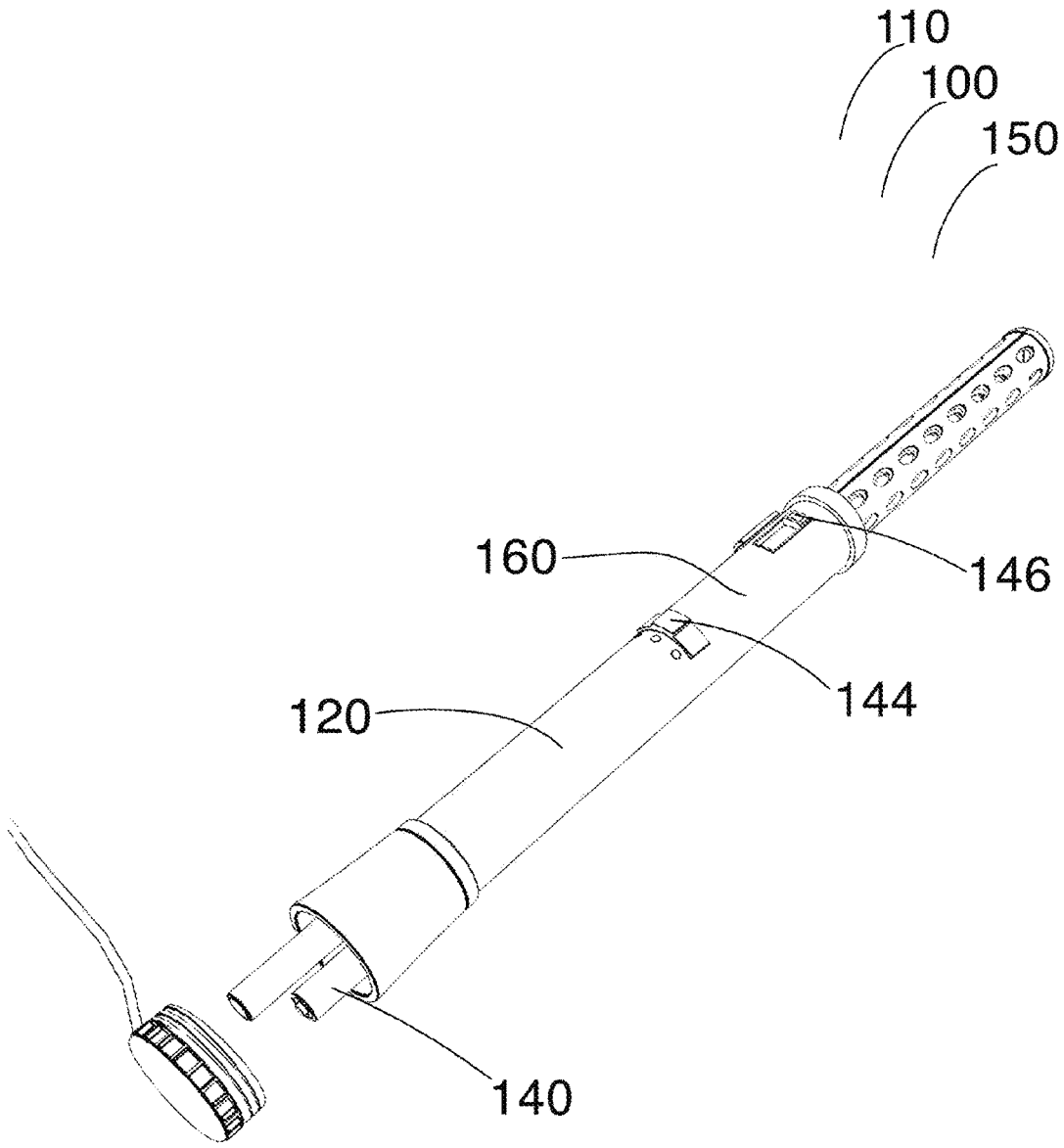
FIG. 3 is a perspective view of the hair drying and styling system of FIG. 1, according to an embodiment of the present disclosure.

FIG. 3 shows a front perspective view of the hair drying and styling system 100 of FIG. 1, according to an embodiment of the present disclosure. As above, the hair drying and styling system 100 may include the hair styling tool assembly 110 having the handle 120, the split barrel 124, the detachable brush attachment 136, the power source 140, the control panel 144, and the hair dryer 160. The split barrel 124 comprises a plurality of apertures 164 for allowing passage of air from the hair dryer 160 to the hair wrapped around the detachable brush attachment 136. The split barrel 124 comprises an elongated cylindrical profile. The detachable brush attachment 136 also comprises a plurality of apertures 164 for allowing passage of air from the hair dryer 160 to the hair wrapped around the detachable brush attachment 136. The detachable brush attachment 136 comprises a hollow cylindrical profile. The hollow cylindrical profile is configured to encircle the split barrel 124.

Figure 4:
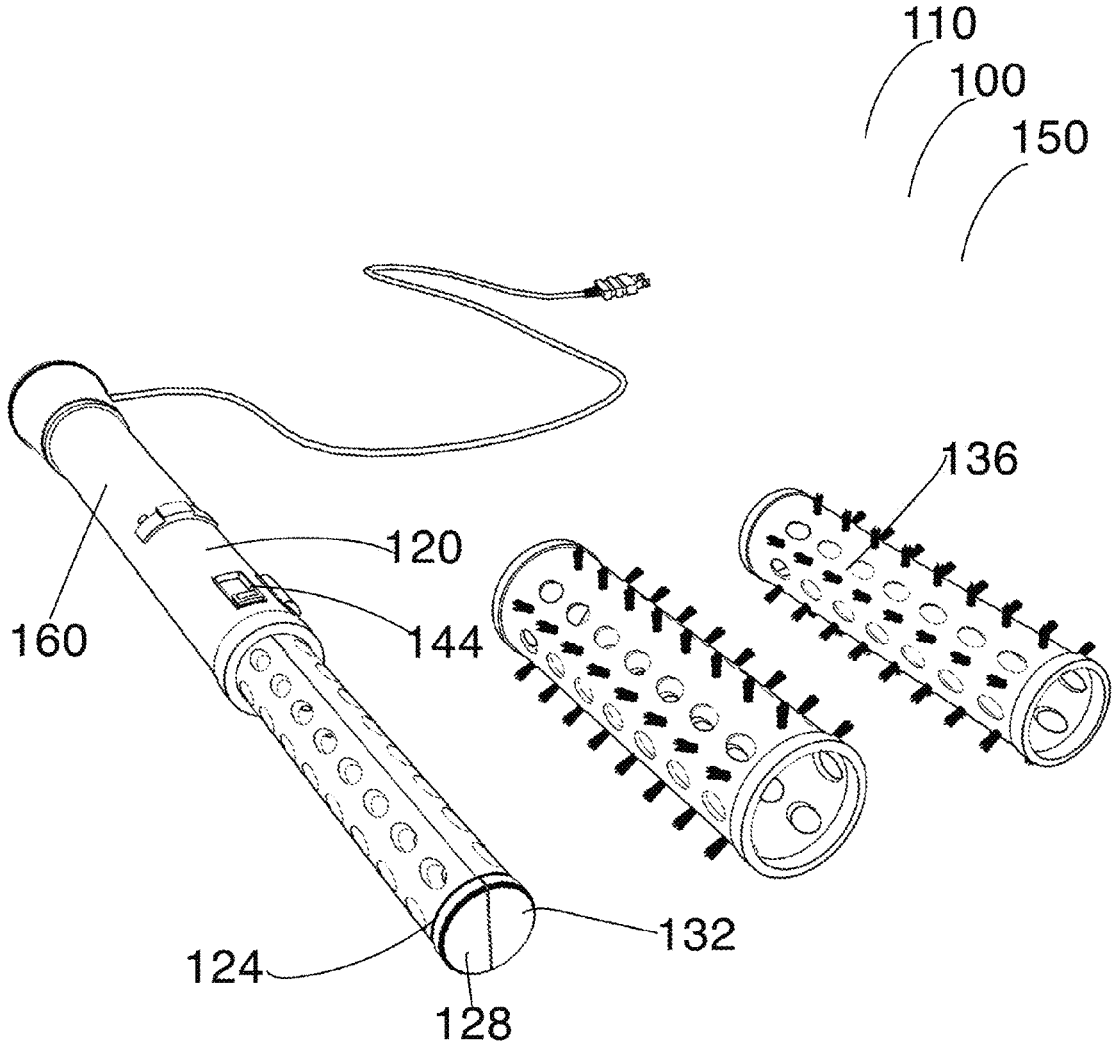
FIG. 4 is a perspective view of the hair drying and styling system of FIG. 1, according to an embodiment of the present disclosure.

FIG. 4 shows a front perspective view of the hair drying and styling system 100 of FIG. 1, according to an embodiment of the present disclosure. As above, the hair drying and styling system 100 may include the hair styling tool assembly 110 having the handle 120, the split barrel 124, the detachable brush attachment 136, the power source 140, the control panel 144, and the hair dryer 160. The power source 140 may include batteries and a power cord or other suitable powering means. The power source 140 may be configured within the handle 120 of the hair styling tool assembly 110. The detachable brush attachment 136 is rotatable. The detachable brush attachment 136 is manipulated via the control panel. The control panel 144 comprises buttons for manipulating the hair styling tool assembly 110. The detachable brush attachment 136 is releasable from an end of the split barrel 124 opposite of the handle 120. The first-member 128 and the second-member 132 are semi-arcuate. The first-member 128 and the second-member 132 comprise a channel between each other when securing the detachable brush attachment 136. The channel is compressed when a user removes the detachable brush attachment 136 by compressing the first-member 128 and the second-member 132.

Figure 5:
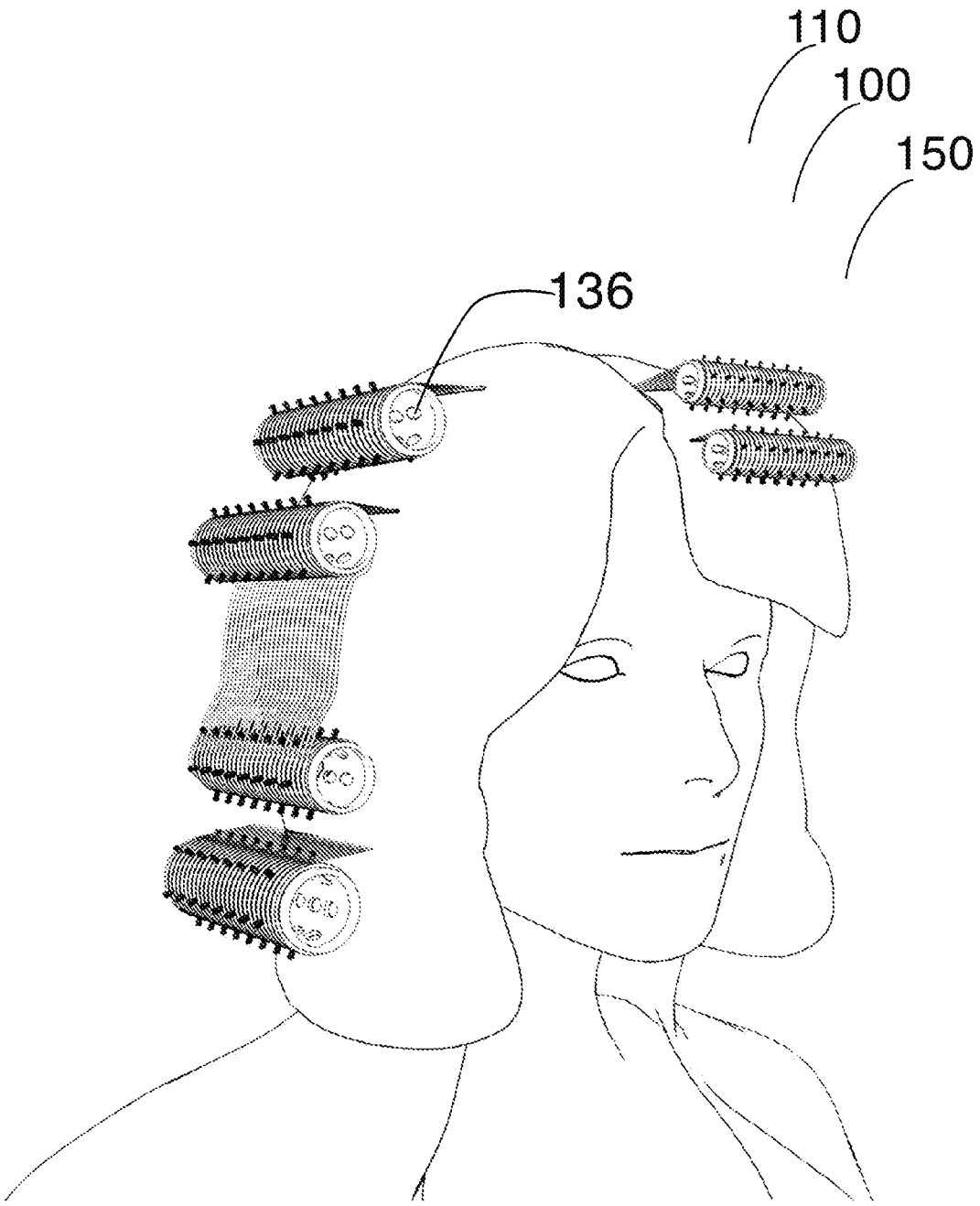
FIG. 5 is a perspective view of the hair drying and styling system of FIG. 1, according to an embodiment of the present disclosure.

FIG. 5 shows a front perspective view of the hair drying and styling system 100 of FIG. 1, according to an embodiment of the present disclosure. As above, the hair drying and styling system 100 may include the hair styling tool assembly 110 having the handle 120, the split barrel 124, the detachable brush attachment 136, the power source 140, the control panel 144, and the hair dryer 160. The hair dryer may be hand-held 160. The detachable brush attachment 136 comprises a hair curler with bristles which may be released from the split barrel 124 and left in hair for drying. The control panel 144 may include temperature control, a power-button, a release button 146 and other setting-buttons.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A hair drying and styling system comprising:
a hair styling tool assembly;
a handle;
a split barrel having;
a first-member; and
a second-member;
a detachable brush attachment;
a power source;
a control panel; and
a hair dryer;
wherein said hair styling tool assembly comprises said handle, said split barrel, said detachable brush attachment, said power source, said control panel, and said hair dryer in functional combination;
wherein said split barrel comprises said first-member and said second-member opposed in relation to each other;
wherein said detachable brush attachment is configured to be securable around said first-member and said second-member;
wherein said first-member and said second-member are able to be manipulated via said control panel creating a space between said first-member and said second-member;
wherein said detachable brush attachment is able to be removed from said split barrel when a release button of said control panel is manipulated to press said first-member and said second-member together;
wherein said detachable brush attachment is configured to be detached when hair is dried and provides a hair curler left in said hair; and
wherein said split barrel comprises a plurality of apertures for allowing passage of air from hair dryer to said hair wrapped said detachable brush attachment.

2. The hair drying and styling system of claim 1, wherein said detachable brush attachment comprises a hollow cylindrical profile.

3. The hair drying and styling system of claim 2, wherein said hollow cylindrical profile is configured to encircle said split barrel.

4. The hair drying and styling system of claim 1, wherein said power source comprises batteries.

5. The hair drying and styling system of claim 4, wherein said power source is configured within said handle of said hair styling tool assembly.

6. The hair drying and styling system of claim 1, wherein said power source comprises a power cord.

7. The hair drying and styling system of claim 1, wherein said detachable brush attachment is rotatable.

8. The hair drying and styling system of claim 1, wherein said detachable brush attachment is manipulated via said control panel.

9. The hair drying and styling system of claim 1, wherein said detachable brush attachment is releasable from an end of said split barrel opposite of said handle.

10. The hair drying and styling system of claim 1, wherein said first-member and said second-member are semi-arcuate.

11. The hair drying and styling system of claim 1, wherein said first-member and said second-member comprise a channel between each other when securing said detachable brush attachment.

12. The hair drying and styling system of claim 1, wherein said channel is compressed when a user removes said detachable brush attachment by compressing said first-member and said second-member.

13. The hair drying and styling system of claim 1, wherein said hair dryer is hand-held.

14. The hair drying and styling system of claim 1, wherein said detachable brush attachment comprises a hair curler with bristles.

15. The hair drying and styling system of claim 1, wherein said control panel comprises buttons for manipulating said hair styling tool assembly.

16. The hair drying and styling system of claim 15, wherein said control panel comprises a power-button.

17. The hair drying and styling system of claim 1, wherein said split barrel comprises an elongated cylindrical profile.

18. A hair styling tool assembly, the hair styling tool assembly comprising:
a hair styling tool assembly;
a handle;
a split barrel having;
a first-member; and
a second-member;
a detachable brush attachment;
a power source;
a control panel; and
a hair dryer;
wherein said hair styling tool assembly comprises said handle, said split barrel, said detachable brush attachment, said power source, said control panel, and said hair dryer in functional combination;
wherein said split barrel comprises a plurality of apertures for allowing passage of air from said hair dryer to said hair wrapped around said detachable brush attachment;
wherein said split barrel comprises an elongated cylindrical profile;
wherein said detachable brush attachment comprises a plurality of apertures for allowing passage of air from said hair dryer to said hair wrapped around said detachable brush attachment;
wherein said hair dryer is hand-held;
wherein said split barrel comprises said first-member and said second-member opposed in relation to each other;
wherein said first-member and said second-member are semi-arcuate;
wherein said detachable brush attachment is configured to be securable around said first-member and said second-member;
wherein said first-member and said second-member comprise a channel between each other when securing said detachable brush attachment;
wherein said channel is compressed when a user removes said detachable brush attachment by compressing said first-member and said second-member;
wherein said detachable brush attachment comprises a hair curler with bristles;
wherein said detachable brush attachment comprises a hollow cylindrical profile;
wherein said hollow cylindrical profile is configured to encircle said split barrel;
wherein said first-member and said second-member are able to be manipulated via said control panel creating a space between said first-member and said second-member;
wherein said detachable brush attachment is able to be removed from said split barrel when a release button of said control panel is manipulated to press said first-member and said second-member together;

wherein said detachable brush attachment is releasable from an end of said split barrel opposite of said handle;

wherein said detachable brush attachment is rotatable;

wherein said detachable brush attachment is manipulated via said control panel;

wherein said control panel comprises buttons for manipulating said hair styling tool assembly;

wherein said control panel comprises a power-button;

wherein said power source comprises batteries and a power cord;

wherein said power source is configured within said handle of said hair styling tool assembly; and wherein said detachable brush attachment is configured to be detached when hair is dried and provides a hair curler left in said hair.

* * * * *